US006167919B1

(12) United States Patent
Füchsl et al.

(10) Patent No.: US 6,167,919 B1
(45) Date of Patent: Jan. 2, 2001

(54) METHOD AND DEVICE FOR THE TWISTING OF AT LEAST TWO SINGLE-LINES

(75) Inventors: Klaus Füchsl, Niedermotzing; Fritz Dräxlmaier, Geisenhausen, both of (DE)

(73) Assignees: Gluth Systemtechnik GmbH, Straubing; Lisa Draxlmaier GmbH, Vilsbiburg, both of (DE)

( * ) Notice: Under 35 U.S.C. 154(b), the term of this patent shall be extended for 0 days.

(21) Appl. No.: 09/242,075

(22) PCT Filed: Aug. 5, 1997

(86) PCT No.: PCT/EP97/04265

§ 371 Date: Oct. 26, 1999

§ 102(e) Date: Oct. 26, 1999

(87) PCT Pub. No.: WO98/06155

PCT Pub. Date: Feb. 12, 1998

(30) Foreign Application Priority Data

Aug. 6, 1996 (DE) ..... 196 31 770

(51) Int. Cl.[7] ..... B21F 7/00
(52) U.S. Cl. ..... 140/149
(58) Field of Search ..... 140/149; 57/314

(56) References Cited

U.S. PATENT DOCUMENTS 539,139 * 5/1895 Lee ..... 140/149
3,750,720 * 8/1973 Steigerwald ..... 140/149
3,847,190 11/1974 Forester ..... 140/149
4,910,952 * 3/1990 Johnson ..... 57/314

FOREIGN PATENT DOCUMENTS 29 25 050 1/1981 (DE) .
0 103 963 3/1984 (EP) .

* cited by examiner

*Primary Examiner*—Lowell A. Larson
(74) *Attorney, Agent, or Firm*—Armstorng, Westerman, Hattori, McLeland & Naughton

(57) ABSTRACT

The present invention refers to a method of twisting at least two individual conductors comprising the following steps:

Figure 2:
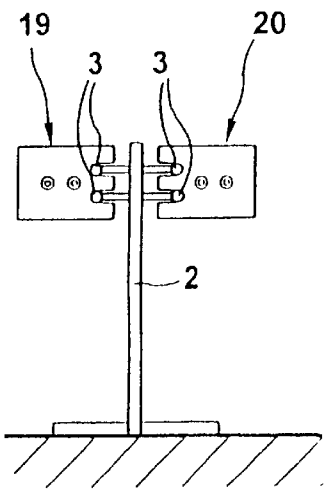

fixing the first conductor ends of individual conductors, which have been cut off to a suitable length, in respective separate untwisting fixation means which are rotatable essentially parallel to a twisting axis;

fixing the second conductor ends of said individual conductors in respective separate twisting fixation means which are arranged such that they are adapted to be rotated in common about said twisting axis;

arranging a twisting slide between the essentially tensioned conductors; and rotating the twisting fixation means in common about the twisting axis and rotating the untwisting fixation means about the conductor axis of the respective conductors in the same direction.

This method aims at achieving a reduced production expenditure for twisted conductors on the basis of more flexible production conditions. In addition, the present invention refers to an apparatus for twisting at least two individual conductors.

20 Claims, 6 Drawing Sheets

METHOD AND DEVICE FOR THE TWISTING OF AT LEAST TWO SINGLE-LINES

The present invention refers to a method of twisting at least two individual conductors and to a twisting apparatus used for this purpose.

Twisted conductors are used in great number of cases and for a great variety of purposes where electromagnetic compatibility (EMC) is desired. One field of application is the use of such conductors in the field of automotive engineering, e.g. for loudspeaker conductors or airbag conductors. Up to now, conductor manufacturers have always produced twisted conductors in the form of endless twisted conductors which were wound onto drums for the purpose of selling. In the case of such endless twisting operations, the cable drums with the "endless" individual conductors are rotatably secured to the twisting head and rotate together therewith about the twisting axis. The twisted conductors are then cut to length for the respective intended use, the ends are partly untwisted and the means in question, e.g. contact terminals, attachment members, individual wire sealing means, are attached thereto. These processes require a large amount of work and are therefore expensive. In addition, the stock of twisted conductors must be comparatively large, since said conductors are produced with different diameters, twisting gradients, numbers of individual conductors, different combinations of colours of the individual conductors, etc. for the respective intended use.

It is now the object of the present invention to provide a method of twisting individual conductors, which makes the production of twisted conductors more attractive for cable manufacturers with regard to the expenditure of work, the manufacturing costs and the storage expenses.

According to the present invention, this object is achieved by a method comprising the following steps:

- fixing the first conductor ends of individual conductors, which have been cut off to a suitable length, in respective separate untwisting fixation means which are rotatable essentially parallel to a twisting axis;
- fixing the second conductor ends of said individual conductors in respective separate twisting fixation means which are arranged such that they are adapted to be rotated in common about said twisting axis;
- arranging a twisting slide between the essentially tensioned conductors; and
- rotating the twisting fixation means in common about the twisting axis and rotating the untwisting fixation means about the conductor axis of the respective conductors in the same direction.

The enormous advantage of this method is to be seen in the fact that individual conductors can be cut to a specific length, perhaps stripped and provided with various components prior to the twisting operation. The conductor ends, which may perhaps be provided with attachments, are then inserted in the respective fixation means and clamped in position, each fixation means having preferably associated therewith one conductor end. The twisting fixation means and the twisting slide then carry out the twisting of the individual conductors, whereas the untwisting fixation means can remain at a position where they are arranged essentially parallel to the twisting axis. Since, due to the common rotational movement of the twisting fixation means, the individual conductors are also rotated about their own axis in the case of each rotation about the twisting axis, the untwisting fixation means will take care that a rotational movement of each individual conductor in the same direction takes place so that said individual conductors cannot become twisted in themselves.

On the basis of the method according to the present invention, the amount of material that has to be kept in stock can be reduced, since it is no longer necessary to keep all the combinations of conductor colours and conductor cross-sections in stock. The combinations of conductors required can now be produced from standard conductors in accordance with the cable manufacturer's wishes. In contrast to the processing of conventional twisted conductors, problems will no longer arise with regard to untwisting, smoothing, unwinding from drums, cutting, cutting to length, stripping, fastening and mounting of sealing means. For subjecting conductors which have already been twisted to this kind of processing, special machines are required. The method according to the present invention permits processing on standard machines, since twisting can be carried out as the last manufacturing step. In this connection, also the reliability of the process and the quality of the twisted conductors will be improved. By means of said method, it is easily possible to process prefabricated conductors with arbitrary kinds of attachements at the conductor ends. The untwisting operation takes care that torsional loads at the ends of the individual conductors will be avoided.

The twisting slide can be arranged in the vicinity of the twisting fixation means between the conductors in an advantageous manner, and, during the twisting operation, it can be displaced in the direction of the untwisting fixation means. This permits a more precise control of the twisting operation, since, initially, said twisting operation begins as closely as possible to the twisting fixation means.

In addition, the displacement speed of the twisting slide can be controlled in dependence upon the speed with which the twisting fixation means rotate about the twisting axis.

The twisting gradient of the individual conductors can be varied in this way. This can even be done to such an extent that a twisted cable produced from individual conductors can comprise different sections with different twisting gradients. For keeping the tensile stresses which act on the individual conductors during the twisting operation essentially constant, the untwisting fixation means can be moved in the direction of the twisting fixation means in a controlled manner during the twisting operation. It is readily evident that, due to the twisting of individual conductors having a specific length, only cables having a shorter final length can be produced depending on the twisting gradient. This "shrinkage" is preferably taken into account by a controlled displacement of the twisting fixation means. It is, of course, also possible to move the untwisting fixation means relative to the twisting fixation means. It turned out that a certain amount of pretension on the individual conductors is advantageous for the twisting operation.

In accordance with a further variant, it is suggested that the cutting to length and/or fixing of the individual conductors should be carried out automatically. Accordingly, further intermediate steps can be added, when the individual conductors are subjected to additional prefabricating steps, e.g. by attaching suitable terminals to the ends etc. This measure will be particularly suitable when twisted cables in high numbers of pieces are dealt with.

In accordance with an advantageous embodiment, the untwisting fixation means can be moved, after the clamping of the first conductor ends, along the twisting axis away from the twisting fixation means so as to insert the conductors into a twisting apparatus. The untwisting fixation means are thus used as a transport device for the individual conductors.

One feature that can be provided in this connection is that the specific insertion length is smaller than the maximun distance between the untwisting and twisting fixation means at the beginning of the twisting operation, and that, after the fixing of the second ends in the twisting fixation means, the conductors are tensioned by a renewed displacement of the untwisting fixation means. on the one hand, this process will facilitate the insertion of the second ends of the individual conductors, since they can be inserted into the twisting fixation means while they are still comparatively loose and not pretensioned and, on the other hand, a pretension is purposefully applied to the individual conductors by displacing the untwisting fixation means.

According to an advantageous embodiment, the conductors can be twisted more closely in the area of their conductor ends than in the residual area. This closer twisting in the area of the conductor ends constitutes a kind of knotting whereby the twisting in its entirety will be secured more reliably. Hence, inadvertent untwisting of the conductors will occur less easily.

In addition, the present invention refers to a twisting apparatus for twisting at least two individual conductors. This twisting apparatus comprises at least two untwisting fixation means used for fixing conductor ends and arranged such that they are adapted to be rotated separately and substantially parallel to a twisting axis, at least two twisting fixation means used for fixing the second conductor ends and arranged in opposed relationship with said untwisting fixation means, said twisting fixation means being arranged such that they are adapted to be rotated about the twisting axis in common, and a twisting slide which is adapted to be positioned between the conductors, said untwisting fixation means and said twisting fixation means being adapted to be moved relative to one another along the twisting axis.

By means of this apparatus, the method according to the present invention can be carried out in an advantageous manner and the advantages underlying the present invention can be achieved. This apparatus has a very small width and its length must only correspond to the length predetermined by the initial length of the individual conductors which is required for the twisting operation.

According to an advantageous embodiment, the untwisting fixation means can be arranged on a common untwisting slide such that they are displaceable along the twisting axis by means of a linear drive. The linear drive can be controlled very precisely, but it can also produce comparatively high insertion speeds. The drive for the untwisting fixation means is then preferably provided on the untwisting slide as well.

The twisting slide can also be arranged on a carriage such that it is adapted to be displaced along the twisting axis by means of a linear drive, whereby the twisting gradient can be adjusted more precisely, since the conductor section which is just being twisted is always located directly at the twisting slide. In order to simplify the structural design of the device, the twisting fixation means can be arranged on a common support which is adapted to be rotated about the twisting axis.

In accordance with one embodiment, it will be of advantage when the untwisting fixation means and/or the twisting fixation means each comprise a fixed clamping jaw and a movable clamping jaw. It will then suffice to control the movable clamping jaw for clamping the ends of the individual conductors in position. According to an advantageous embodiment, the clamping jaws comprise a prismatic clamping area which is adjustable in size. A clamping area having a structural design of this kind will automatically adapt itself to the various diameters of the individual conductors so that a great variety of conductor sizes can be used without any adjustment measures.

In order to permit the clamping jaws to carry out the clamping function during the twisting operation without any additional supply of energy, e.g. by hydraulic or pneumatic pressure, the fixed and the movable clamping jaw can be spring-loaded in the clamping direction with the aid of a spring means. Hence, it will suffice to apply a suitable opening force for opening the clamping jaws.

In accordance with a further embodiment, the untwisting fixation means and the twisting fixation means each provide a stop for the conductor ends so that a precisely positioned insertion can be carried out.

According to a preferred embodiment, the untwisting fixation means and the twisting fixation means can comprise reception means for attachments at the conductor ends, said reception means being displaced relative to the clamping area of the clamping jaws. The attachments are therefore positioned such that they are protected comparatively well during the twisting operation and they are prevented from being damaged.

In accordance with an advantageous embodiment, a control means can be provided, which coordinates the speeds of the untwisting fixation means and of the twisting fixation means and the displacement speeds of the twisting fixation means and of the twisting slide according to predetermined values. This permits a very efficient, fully automatic production of twisted individual conductors, even of those having different twisting gradients, precisely according to the program in question.

According to a further embodiment, it is suggested that at least two twisting stations comprising corresponding structural components should be arranged in an apparatus side by side, whereby a tandem arrangement is formed. This permits the production of at least two twisted cables at the same time, the linear drives being adapted to be used for both twisting stations.

For taking into account the reduction of the length of the individual conductors by the twisting operation, the twisting fixation means can be arranged such that they are displaceable along the linear guide means with the aid of a transport means. Maintaining a desired pretension, a pneumatic cylinder with couterpressure control can permit a displacement of the twisting fixation means due to the tension produced by the shrinkage of length.

Figure 1:
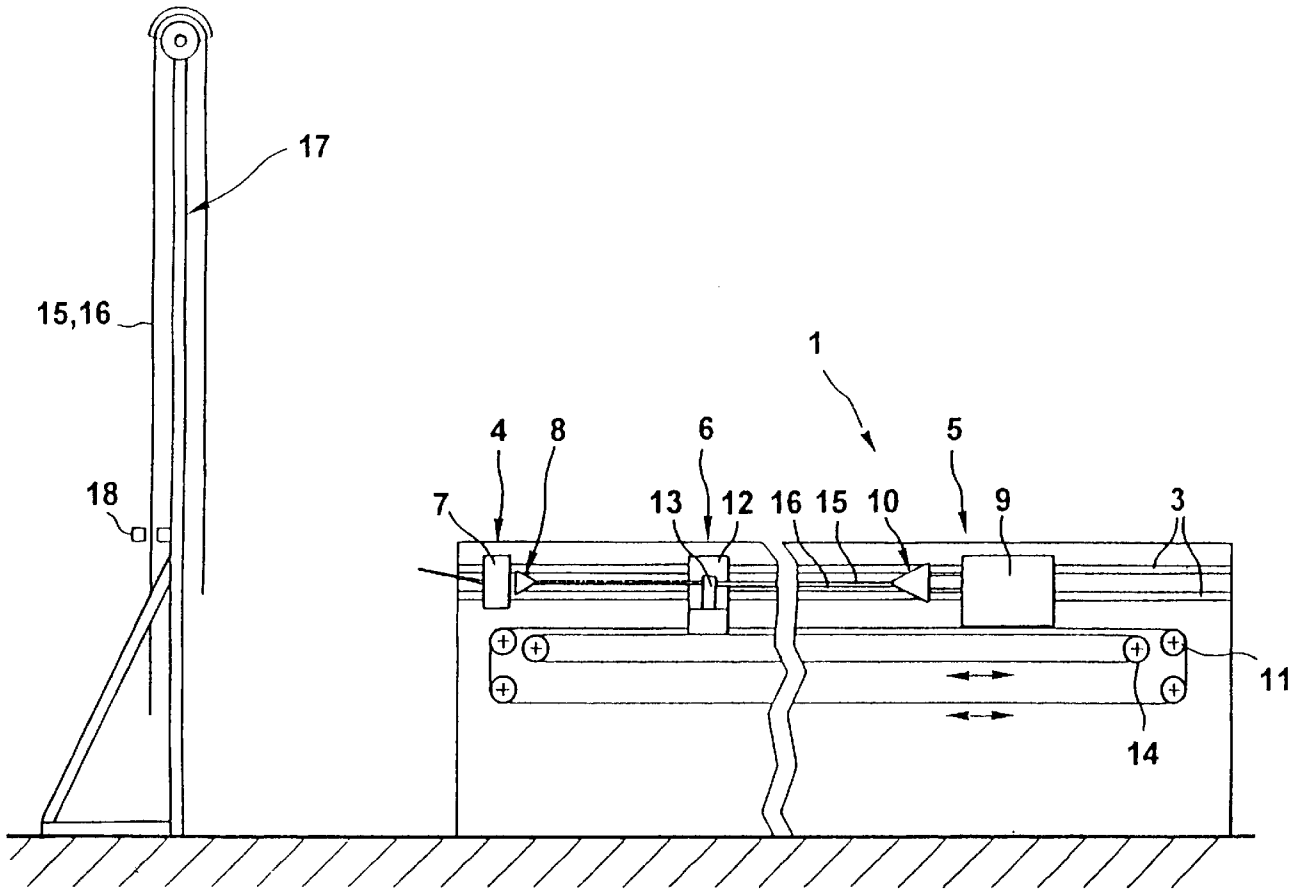
Figure 3:
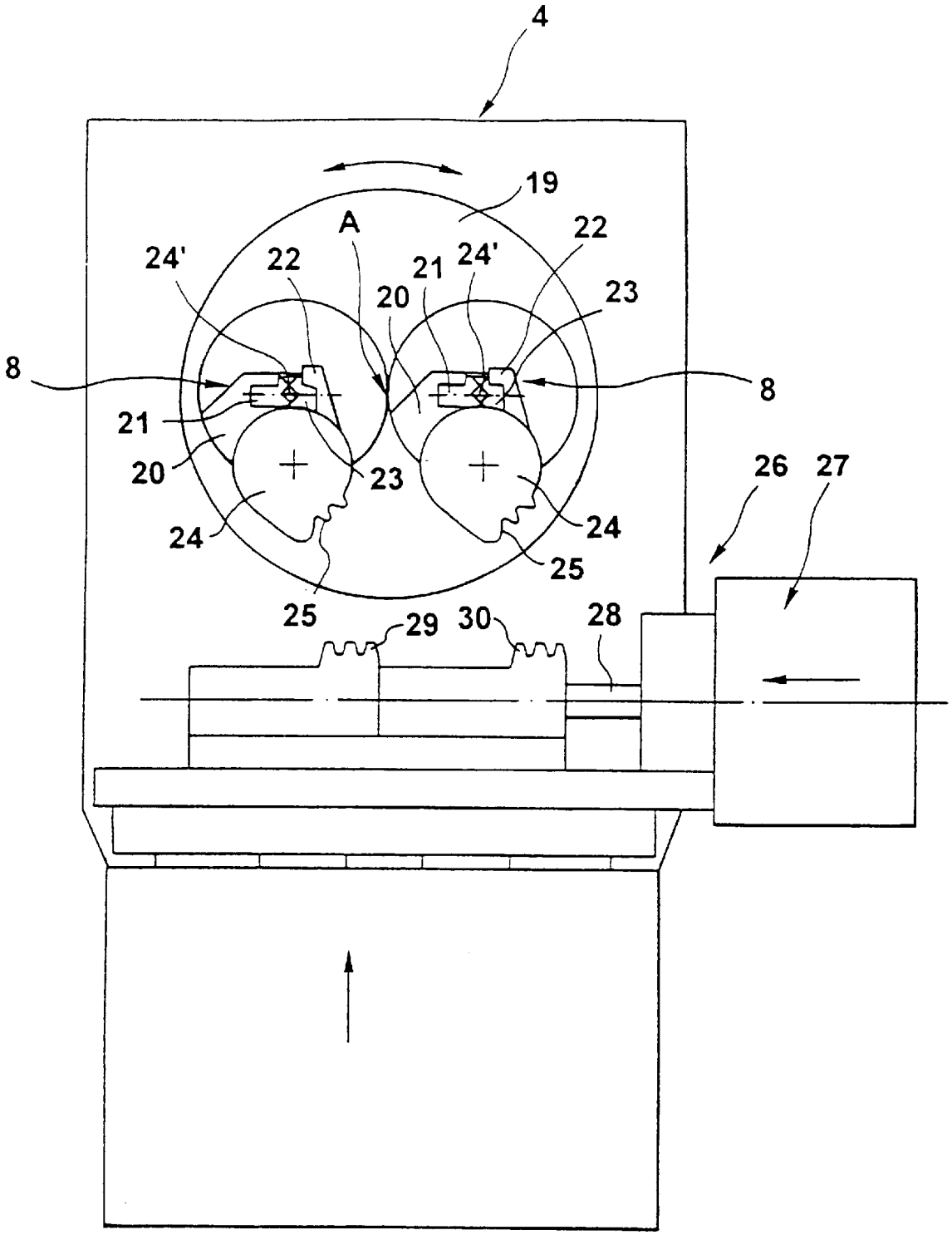
Figure 4:
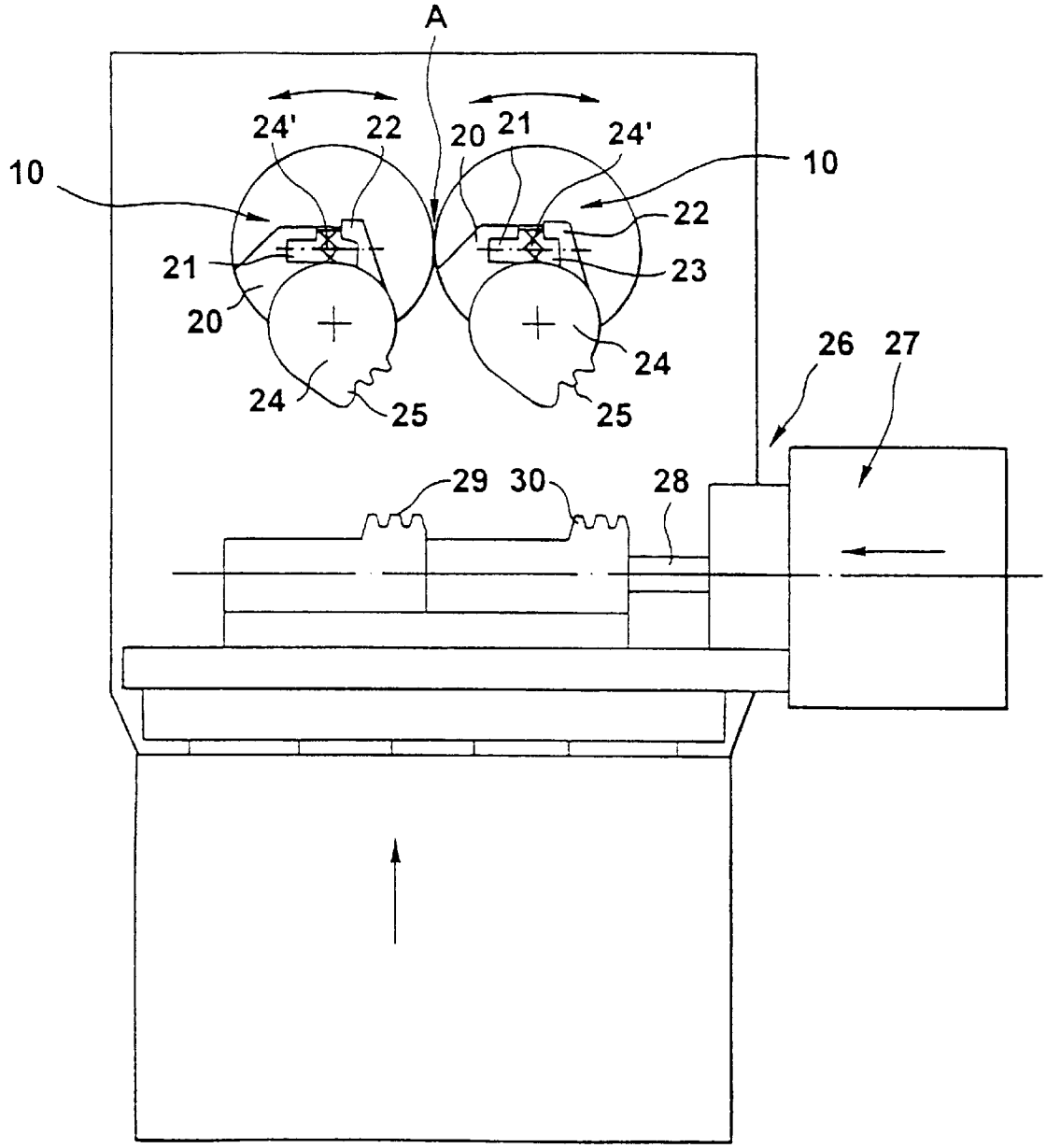
Figure 5:
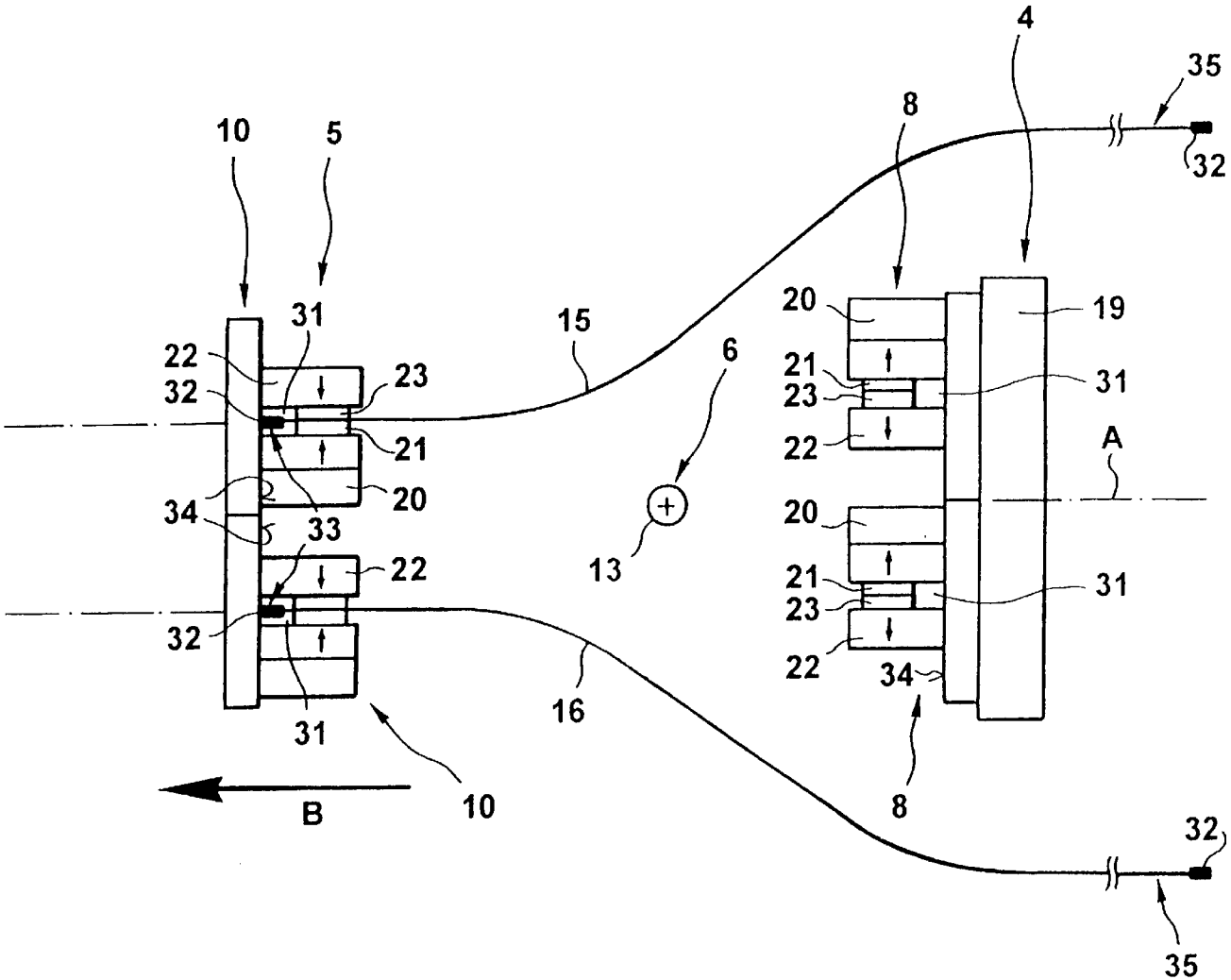
Figure 6:
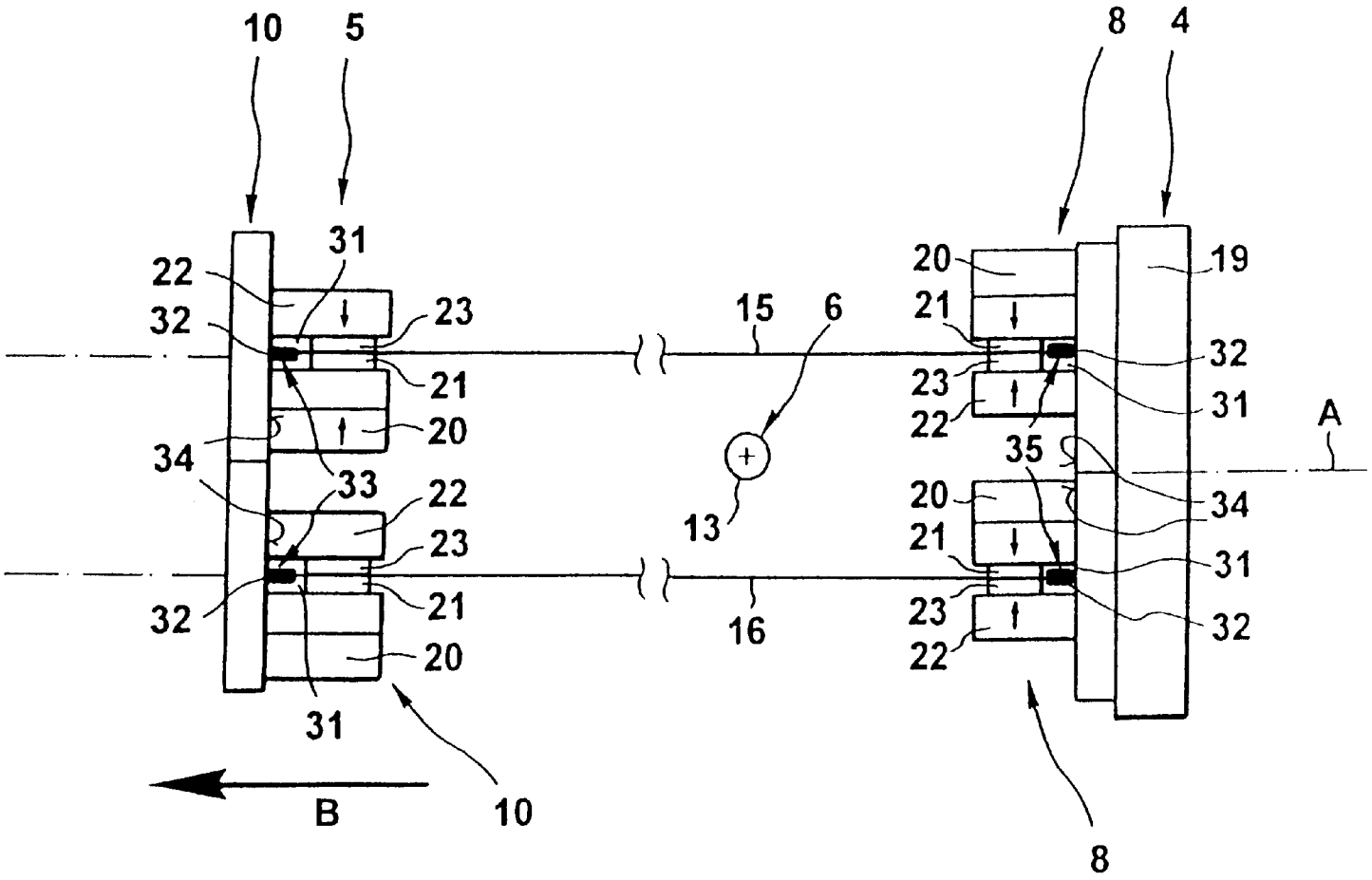
Figure 7:
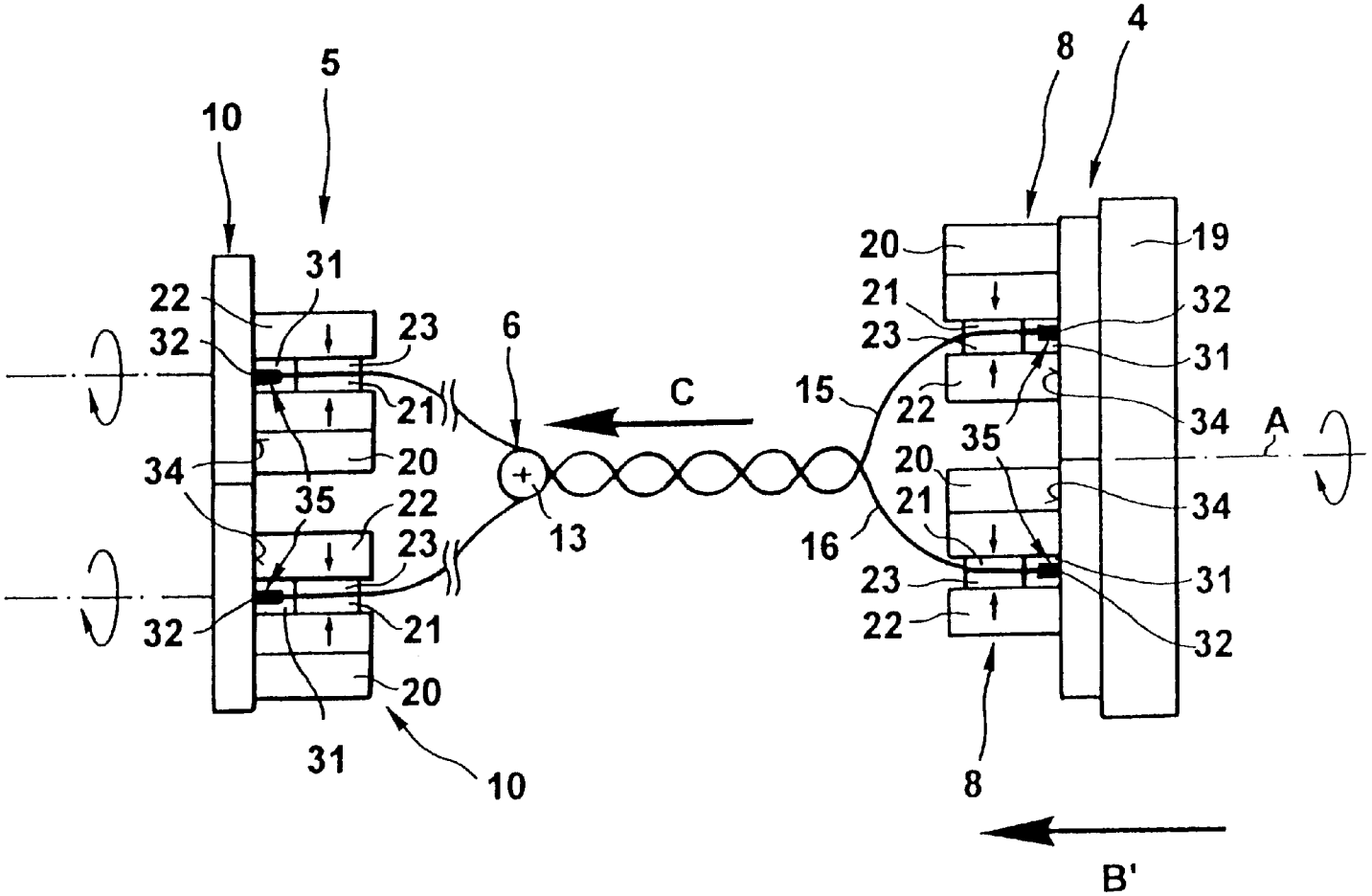

In the following, one embodiment of the present invention will be explained in detail on the basis of a drawing, in which:

FIG. 1 shows a schematic front view of the twisting apparatus according to the present invention provided with a cable post, FIG. 2 shows a schematic side view of the apparatus according to FIG. 1, FIG. 3 shows a schematic view of the twisting head of the apparatus, FIG. 4 shows a schematic view of the untwisting fixation means of the apparatus, FIG. 5 shows a schematic representation of a first method step, FIG. 6 shows a schematic representation of a second method step, and FIG. 7 shows a schematic representation of a third method step.

The twisting apparatus shown in FIGS. 1 and 2 comprises essentially a machine column 2 with linear guide means 3, and a twisting head 4, an untwisting head 5 and a twisting slide 6, which are arranged on each of said linear guide means 3. The twisting head 4 essentially consists of a twisting motor 7 and of twisting fixation means 8 driven by said motor 7. The twisting head 4 is held at its starting position via a pneumatic cylinder. During the twisting operation, the twisting head 4 is displaced along the linear guide means 3 in the direction of the untwisting head 5 (counterpressure adjustable).

The untwisting head 5, however, which consists of a bearing reception means 9 and of the untwisting fixation means 10, is adapted to be displaced along the linear guide means 3 with the aid of a linear drive 11.

The twisting slide 6, which consists essentially of a carriage 12 displaceable along the linear guide means 3 and of an upwardly directed pin 13, is also driven by a linear drive 14 by means of which it is displaceable. The pin 13 engages between the individual conductors 15 and 16 which are arranged between the twisting fixation means 8 and the untwisting fixation means 10. Furthermore, additional brush devices can be arranged within the apparatus, said brush devices being used for calming the conductors 15 and 16 during the twisting operation (not shown).

In addition, a control device can be provided by means of which the process steps carried out at the twisting head 4, the untwisting head 5 and the linear drives 11 and 14 are coordinated.

A post system 17 can be provided as an individual-conductor supplier, said post system 17 having arranged thereon many individual conductors 15, 16 in parallel juxtaposed relationship. Brushes 18 provided on said post system 17 take care that individual conductors 15, 16 which are drawn off the post system 17 will not entrain other conductors. The individual conductors 15, 16 were previously cut off to a suitable length and, if necessary, prefabricated.

As can be seen in FIG. 2, the twisting apparatus 1 shown is a tandem system comprising a first twisting station 19 and a second twisting station 20.

Making reference to FIGS. 3 and 4, the twisting head 4 and the untwisting head 5 will be described in detail hereinbelow.

In the apparatus shown, the twisting head 4 (FIG. 3) comprises a support 19, which is adapted to be rotated about a twisting axis A and which has arranged thereon two twisting fixation means 8 symmetrically with regard to the twisting axis A. The twisting fixation means 8 comprise a fixed clamping jaw 20 with a prismatic clamping insert 21 and a movable clamping jaw 22 with a prismatic clamping insert 23. The clamping inserts 21 and 23 delimit a square clamping opening 24' which is adjustable in size on the basis of a comblike interengagement of the clamping inserts 21 and 23. The movable jaw 22 is connected to a rotatable opening wheel 24 provided with engagement teeth 25. In the condition shown, the fixed jaw 20 and the movable jaw 22 are urged towards one another by a spring means so as to produce the clamping effect so that the opening wheel 24 is used for opening against the effect produced by the spring means.

For moving the movable jaw 22, an opening device 26 is provided, which comprises a vertically adjustable pneumatic unit 27 acting by means of its piston 28 on rack sections 29 and 30 which are vertically movable as well. These rack sections 29 and 30 are adapted to be brought into engagement with the engagement teeth 25 of the opening wheels 24, the movable jaws 22 being transferred to their open position by moving the piston 28 to the left. Since the clamping effect is achieved by the spring means, which are not shown, at the jaws 20 and 22, the opening device 26 is moved to a suitable level and into engagement with the opening wheel 24 only if the jaws are to be opened.

Due to the fact that the twisting fixation means 8 are arranged on the support 19, also said twisting fixation means will rotate about the twisting axis A without changing their position relative to the support 19.

The untwisting head 5 (FIG. 4) comprises two untwisting fixation means 10, each of said untwisting fixation means being adapted to be rotated separately about axes of rotation which extend parallel to the twisting axis A. Since the structural design of the untwisting fixation means 10 and of the opening device 26 corresponds to the structural design of the twisting fixation means 8 in all other respects, identical reference numerals can be used, and a more detailed description can be dispensed with. In order to supplement the above, it should also be pointed out that the untwisting head 5 with the bearing reception means 9 is adapted to be displaced along the linear guide means 3, the linear drive 11 being used for driving the untwisting head in this case. The untwisting fixation means 10 are driven either in common by a single drive or individually or they are merely supported. Coupling to the linear drive 11 is easily possible as well.

With the aid of FIGS. 5, 6 and 7, the mode of operation of the above-described embodiment will now be explained in detail in the following.

In the top views, it can additionally be seen that the clamping inserts 21 and 23 are shorter than the movable jaw 22 and the fixed jaw 20 so that a reception opening 31 is formed in axially displaced relationship with the clamping inserts 21, 23, said reception opening 31 accommodating attachments 32, e.g. contact terminals, of the indvididual conductors 15, 16.

On the basis of FIG. 5, it can be seen that two conductors 15, 16 have been removed from the post system 17 and that their first ends 33 with the contact terminals 32 have been inserted into the untwisting fixation means 10. When these conductors are being inserted, a respective single conductor 15, 16 is inserted into a suitable untwisting fixation means 10. For this purpose, the movable jaw 22 must be opened by the opening device 26. The ends 33 are then advanced up to a stop surface of the untwisting fixation means 10 so that they are accurately positioned. Following this, the movable jaw 22 is closed by moving the piston 28 and/or by direct moving down of the opening device 26. Due to the comblike interengagement of the clamping inserts 21 and 23, the clamping opening 24' will then automatically adapt itself to the respective diameter of the individual conductors 15, 16 and clamp said conductors.

The untwisting head 5 is located close to the twisting head 4 during this operation and, when the individual conductors have been clamped in position, it is displaced in direction B so that the conductors 15, 16 will be inserted in the apparatus. In so doing, the untwisting head 5 is only displaced to such an extent that the other ends 35 of the conductors 15, 16 can be inserted without tension into the open jaws 20, 22 of the twisting head 4 and advanced up to the stop surface 34.

Opening and the closing of the twisting fixation means 8 is then carried out via the opening device 26 in a manner similar to that described in connection with the untwisting head 5 (cf. FIG. 6).

When the other ends 35 have, again separately, been inserted into the twisting fixation means 8, the untwisting head 5 is again displaced in direction B so as to apply the final tension to the conductors 15, 16. The conductors 15, 16 now extend substantially parallel to one another. During this operation, the pin 13 of the twisting slide 6 is either automatically arranged between the conductors or it moves to this position before the actual twisting operation begins.

During the twisting operation (cf. FIG. 7), the twisting head 4 is rotated about the twisting axis A. This has the effect that the conductors 15, 16 will cross in the area of the pin 13 and twist. Simultaneously, the untwisting fixation means 10 of the untwisting head 5 are rotated individually and parallel to the twisting axis A in the same direction as the twisting head 4 so that a torsional stress is prevented from building up in the individual conductors 15, 16. It follows that the conductors 15, 16 only carry out a twisting movement without carrying out a torsional movement about their own axis, which could perhaps result in admissibly high tensions and a damaged conductor.

The distance between the twisting head 4 and the untwisting head 5 must become smaller during the twisting operation, since the length of the twisted cable will always be shorter than the length of the individual conductors 15, 16. In the present apparatus, the twisting head 4 moves in direction B' towards the untwisting head 5 during the twisting operation. In addition, a suitable tension acting on the conductors 15, 16 is maintained during this process. The linear drive 11 can by power-operated in a suitable manner.

Furthermore, the rotational speed of the twisting head 4 and the displacement speed C of the twisting slide 6 can be coordinated by a control means so that the twisting gradient can be adjusted. Preferably, the conductors 15, 16 are twisted more closely in the vicinity of the twisting head 4 and of the untwisting head 5 so that a kind of knot effect is produced, which makes inadvertent untwisting even more difficult.

When the twisted cable has been finished, the twisting fixation means 8 and the untwisting fixation means 10 will be opened by means of the opening device 26 and the cable will be removed.

As will easily be understandable, conductors having different conductor cross-sections, e.g. 0.35 to 2.5 $mm^2$, and different lengths, e.g. 0.4 to 8 m, can be twisted on such a twisting apparatus 1. In this connection, it is possible that the conductor ends 33 and 35 are provided with attachments 32, e.g. in the form of contact terminals, housings, etc., which are accommodated in the reception openings 31. This can be done because no torsion acts on the individual conductors 15, 16 during the twisting operation. An important point is that the torsion of the individual conductors produced by the twisting fixation means 8 is eliminated by the untwisting fixation means 10.

What is claimed is:

1. A method of twisting at least two individual conductors and operating a twisting apparatus comprising at least two untwisting fixation means (10) used for fixing first conductor ends (33) and arranged such that they are adapted to be rotated separately about an axis of each conductor and substantially parallel to a twisting axis (A), at least two twisting fixation means (8) used for fixing second conductor ends (35) and arranged in opposed relationship with said untwisting fixation means (10) and adapted to be rotated in common about the twisting axis, and a twisting slide (6) which is adapted to be positioned between said conductors (15, 16), said untwisting fixation means (10), and said twisting fixation means (8) being adapted to be moved relative to one another along the twisting axis (A), the method comprising the following steps:

fixing the first conductor ends (33) of individual conductors (15, 16), which have been cut off of a suitable length, in respective separate untwisting fixation means (10) which are rotatable substantially about an axis of each conductor and substantially parallel to a twisting axis (A);

after the fixing of the first conductor ends (33), moving the untwisting fixation means (10) along the twisting axis (A) relative to and away from the twisting fixation means (8) by a specific length so as to insert the conductors (15, 16) into the twisting apparatus;

fixing the second conductor ends (35) of said individual conductors (15, 16) in respective separate at least two twisting fixation means (8) which are arranged such that they are adapted to be rotated in common about said twisting axis (A);

tensioning the conductors;

arranging a twisting slide (6) between the tensioned conductors (15, 16); and rotating the at least two twisting fixation means (8) in common about the twisting axis (A) and rotating the at least two untwisting fixation means (10) about the conductor axis of the respective individual conductors (15, 16) in the same direction and coordinated with the rotation of the twisting fixation means so as to prevent torsional loads on the individual conductors.

2. A method according to claim 1, wherein the twisting slide (6) is arranged in the vicinity of the twisting fixation means (8) between the conductors (15, 16) and is displaced during the twisting operation in the direction of the untwisting fixation means (10).

3. A method according to claim 2, wherein speed of the displacement of the twisting slide (6) is controlled in dependence upon the speed with which the twisting fixation means (8) rotate about the twisting axis (A).

4. A method according to claim 1 wherein, the twisting fixation means (8) are moved relative to and in the direction of the untwisting fixation means (10) in a controlled manner during the twisting operation.

5. A method according to claim 1 wherein, the cutting to length and/or fixing of the individual conductors (15, 16) is/are carried out automatically as a further step.

6. A method according to claim 1 wherein, after the clamping of the first conductor ends (33), the untwisting fixation means (10) are moved along the twisting axis (A) relative to and away from the twisting fixation means (8) by a specific length so as to insert the conductors (15, 16) into a twisting apparatus.

7. A method according to claim 6, wherein the specific insertion length is smaller than the maximum distance between the untwisting and twisting fixation means (8, 10) at the beginning of the twisting operation, and that, after the fixing of the second ends (35) in the twisting fixation means (8), the conductors (15, 16) are tensioned by a renewed relative displacement of the untwisting fixation means (10).

8. A method according to claim 1 wherein, the conductors (15, 16) are twisted more closely in the area of their conductor ends (33, 35) than in the residual area.

9. A twisting apparatus for twisting at least two individual conductors, wherein at least two untwisting fixation means (10) used for fixing conductor ends (33) and arranged such that they are adapted to be rotated separately about an axis of each conductor and substantially parallel to a twisting axis (A), at least two twisting fixation means (8) used for fixing the second conductor ends (35) and arranged in opposed relationship with said untwisting fixation means (10), said twisting fixation means (8) being arranged such that they are adapted to be rotated about the twisting axis (A) in common, and a twisting slide (6) which is adapted to be positioned between said conductors (15, 16), said untwisting fixation means (10) and said twisting fixation means (8) being adapted to be moved relative to one another along the twisting axis (A)

said untwisting fixation means being adapted to rotate in coordination with said twisting fixation means so as to prevent torsional loads on the at least two individual conductors.

10. A twisting apparatus according to claim 9, wherein, the untwisting fixation means (10) are arranged on a common untwisting slide such that they are displaceable along the twisting axis (A) by means of a linear drive (11) to insert the conductors into the twisting apparatus.

11. A twisting apparatus according to claim 9 or 10, wherein the twisting slide (6) is arranged on a carriage (12) such that it is adapted to be displaced along the twisting axis (A) by means of a linear drive (14).

12. A twisting apparatus according to claim 9 wherein, the twisting fixation means (8) are arranged on a common support (19) which is adapted to be rotated about the twisting axis (A).

13. A twisting apparatus according to claim 9 wherein, the untwisting fixation means (10) and/or the twisting fixation means (8) each comprise a fixed clamping jaw (20) and a movable clamping jaw (22).

14. A twisting apparatus according to claim 9 wherein, the clamping jaws (20, 22) comprise a prismatic clamping area which is adjustable in size.

15. A twisting apparatus according to claim 9 wherein, the fixed and the movable clamping jaw (20, 22) are spring-loaded in the clamping direction with the aid of a spring means.

16. A twisting apparatus according to claim 9 wherein, the untwisting fixation means (10) and the twisting fixation means (8) each provide a stop (34) for the conductor ends (33, 35).

17. A twisting apparatus according to claim 9 wherein, the untwisting fixation means (10) and the twisting fixation means (8) comprise reception means (31) for attachments at the conductor ends (33, 35), said reception means (31) being displaced relative to the clamping area of the clamping jaws (20, 22).

18. A twisting apparatus according to claim 9 wherein, a control means is provided, which coordinates the speeds of the untwisting fixation means (10) and of the twisting fixation means (8) and the relative displacement speeds of the twisting fixation means (8) and of the twisting slide (6) according to predetermined values.

19. A twisting apparatus according to claim 9 wherein, at least two twisting stations comprising corresponding structural components are arranged in an apparatus side by side.

20. A twisting apparatus according to claim 9 wherein, the twisting fixation means (8) are arranged such that they are displaceable along the linear guide means (3) with the aid of a transport means, e.g. a pneumatic cylinder with counter-pressure control.

* * * * *

UNITED STATES PATENT AND TRADEMARK OFFICE

CERTIFICATE OF CORRECTION

PATENT NO. : 6,167,919
DATED : January 2, 2001
INVENTOR(S) : Klaus Fuchsl and Fritz Draxlmaier It is certified that error appears in the above-identified patent and that said Letters Patent is hereby corrected as shown below:

ON THE TITLE PAGE

Title should read:

A METHOD OF TWISTING AT LEAST TWO INDIVIDUAL CONDUCTORS

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*